US006691399B1

(12) United States Patent
Hayashi et al.

(10) Patent No.: US 6,691,399 B1
(45) **Date of Patent: *Feb. 17, 2004**

(54) METHOD OF MOUNTING A COIL UNIT FOR USE AS AN IMAGE HEATING APPARATUS

(75) Inventors: Yasuhiro Hayashi, Mishima (JP); Tomoichirou Ohta, Shimizu (JP); Takashi Fujita, Shizuoka-ken (JP); Ryuichirou Maeyama, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/488,790

(22) Filed: Jan. 21, 2000

(30) Foreign Application Priority Data

Jan. 22, 1999 (JP) ..... 11-013933
Jan. 22, 1999 (JP) ..... 11-013934

(51) Int. Cl.[7] ..... H01F 3/04
(52) U.S. Cl. ..... 29/605; 29/598; 29/825
(58) Field of Search ..... 29/605, 598, 825

(56) References Cited

U.S. PATENT DOCUMENTS

| | | | | |
|---|---|---|---|---|
| 3,431,639 A | * | 3/1969 | Reimer et al. | 29/605 |
| 3,600,801 A | * | 8/1971 | Larsen | 29/605 |
| 4,937,931 A | * | 7/1990 | Jacobs et al. | 29/605 |
| 5,747,213 A | | 5/1998 | Okado et al. | 430/124 |
| 5,942,882 A | | 8/1999 | Ohta | 323/282 |

FOREIGN PATENT DOCUMENTS

| | | |
|---|---|---|
| EP | 0 679 961 | 11/1995 |
| EP | 0 753 799 | 1/1997 |
| JP | 55-023788 | 2/1980 |
| JP | 60-257045 | 12/1985 |
| JP | 01-207903 | 8/1989 |

* cited by examiner

*Primary Examiner*—Carl J. Arbes
(74) *Attorney, Agent, or Firm*—Fitzpatrick, Cella, Harper & Scinto

(57) ABSTRACT

A method of mounting a coil inside a rotatable member for heating an image, includes a winding step of winding wire into a coil in a plane to provide a planer coil; and a mounting step of bending the planer coil and mounting it to a supporting member.

10 Claims, 11 Drawing Sheets

METHOD OF MOUNTING A COIL UNIT FOR USE AS AN IMAGE HEATING APPARATUS

FIELD OF THE INVENTION AND RELATED ART

The present invention relates to an image heating apparatus employed in an image forming apparatus such as a copying machine or a printer. In particular, it relates to a method for assembling a coil to be employed in an image heating apparatus.

In image forming apparatuses such as copying machines or printers, a toner image (image formed of developer (toner) comprising resin, magnetic material, coloring material, and the like) is formed through one of image formation processes, for example, an electrophotographic image formation process, or an electrostatic recording process. In some image forming apparatuses, a toner image is directly formed on recording medium, and in others, it is indirectly formed on recording medium, that is, it is formed on a primary image bearer and then, is transferred onto recording medium. The thus formed toner image on recording medium is thermally fixed to recording medium with the use of a fixing apparatus. Although there are various fixing apparatuses, a heat roller type fixing apparatus has been widely used.

A heat roller type fixing apparatus comprises a fixing roller (heat roller) and a pressure roller. The two rollers are pressed against each other, forming a pressure nip (fixing nip). As they are rotated, recording medium on which an unfixed toner image is borne is passed through the fixing nip, being pinched by the two roller. As recording medium is passed through the fixing nip, heat and pressure are applied to the recording medium and the unfixed toner image thereon. As a result, the unfixed toner image is thermally fused to the recording medium. As for a means for heating the fixing roller, i.e., heat roller, a halogen lamp has been commonly used as a heat source. More specifically, a halogen lamp is disposed within a fixing roller to heat the fixing roller from within the fixing roller, so that the surface temperature of the fixing roller is maintained at a proper level for fixing.

There has been proposed a fixing apparatus which employs a heating system based on electromagnetic induction, as the means for heating a fixing roller, i.e., a heat roller. According to this system, eddy current is generated in an electrically conductive layer provided on the inward side of the fixing roller, by a magnetic flux from an exciter coil, so that the electrically conductive layer is heated by Joule heat to increase the temperature of the fixing roller.

A fixing apparatus employing the above described electromagnetic induction based heating system is characterized in that its heat generating source can be placed very close to the toner image to be fixed, and therefore, it takes a much shorter time for this type of fixing apparatus to increase the surface temperature of the fixing roller to a proper level for fixation, from the temperature level at the startup of the apparatus, than a fixing apparatus employing a halogen lamp. It is also characterized in that its heat transmission path to a toner image from the heat generation source is shorter and simpler, and therefore, it is high in thermal efficiency.

However, in order to efficiently generate heat in the electrically conductive layer of a fixing roller such as the above described one, which employed an electromganetic induction based heating system, that is, the system in which eddy currently was generated in the electrically conductive layer provided on the inward side of the fixing roller by a magnetic flux from an exciter coil to generate Joule heat to heat the electrically conductive layer, so that the temperature of the fixing roller was increased by the Joule heat, the exciter coil was desired to be disposed along the inward surface of the fixing roller. However, such disposition of the exciter coil made the exciter coil complicated in shape, which reduced the manufacturing efficiency for the exciter coil, increasing therefore the production cost for the exciter coil, which was a problem.

SUMMARY OF THE INVENTION

The primary object of the present invention is to provide a simple method for assembling an exciter coil into the inward side of the rotational member of an image heating apparatus, so that the manufacturing efficiency for an image heating apparatus can be improved.

According to one of the aspects of the present invention, a method for assembling an exciter coil into the inward side (space) of the image heating rotational member of an image heating apparatus, comprises a step for winding a piece of wire into a flat and spiral coil, and a step for attaching the flatly and spirally wound coil to a supporting member while reshaping the coil so that the curvature of the coil conforms to the curvature of the supporting member.

According to another aspect of the present invention, it is assured that an exciter coil is reliably secured to a supporting member.

According to another aspect of the present invention, an image heating apparatus comprises a rotational member, a coil for generating a magnetic flux, a supporting member for supporting said coil, and a thermally contractible tube for sheathing said coil and supporting member, wherein an image on recording medium is heated by the heat from said rotational member heated by the eddy current generated by the magnetic flux generated in said rotational member by said coil.

Another object of the present invention is to provide an image heating apparatus in which the temperature of said rotational member does not become lower across its longitudinal end portions that its central portion.

According to another aspect of the present invention, an image heating apparatus comprises a rotational member, a coil for generating a magnetic flux, a first supporting portion for supporting said coil, and a second supporting portion for supporting said coil, wherein said first supporting portion is provided with a projection which extends in the direction perpendicular to the direction in which said rotational member moves, and around which said coil is wound, and said second supporting portion supports the longitudinal end portions of said coil, that is, the portions which extend beyond the corresponding longitudinal ends said projection, and is provided with a semicylindrical surface, along which said coil is positioned, and wherein an image on recording medium is heated by the heat from said rotational member heated by the eddy current generated by the magnetic flux generated in said rotational member by said coil.

These and other objects, features, and advantages of the present invention will become more apparent upon consideration of the following description of the preferred embodiments of the present invention, taken in conjunction with the accompanying drawings.

DETAILED DESCRIPTION OF THE EMBODIMENTS

Hereinafter, the preferred embodiments of the present invention will be described with reference to the appended drawings.

Figure 6:
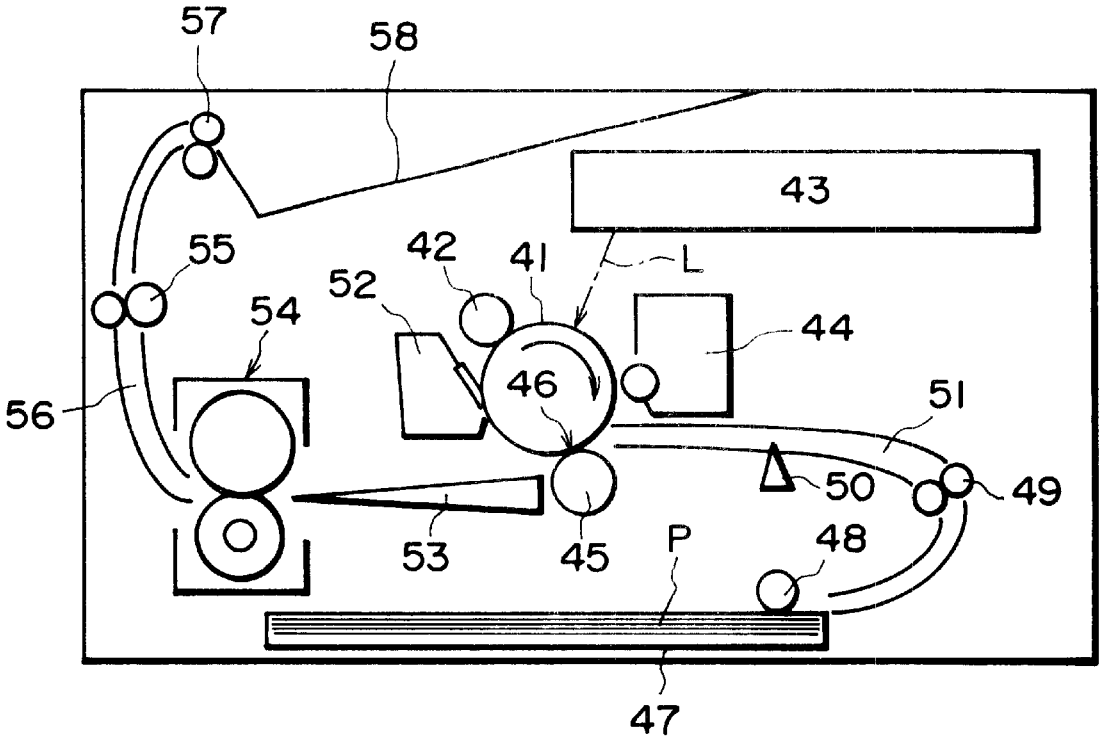
FIG. 6 is a schematic vertical section of an image forming apparatus.

FIG. 6 is a schematic vertical sectional view of an example of an image forming apparatus equipped with an induction type heating apparatus as an apparatus for thermally fixing an image, and depicts the general structure of the image forming apparatus. This image forming apparatus is a laser beam printer which uses a transfer type electrophotographic process. First, this apparatus will be described.

A referential character 41 designates a rotational electrophotographic photosensitive member (hereinafter, photosensitive drum) in the form of a cylindrical drum, which is rotatively driven in the clockwise direction at a predetermined peripheral velocity (process speed).

As the photosensitive drum 41 is rotated, it is uniformly charged to predetermined polarity and potential level by a charge roller 42 as a charging apparatus.

Then, the photosensitive drum 41 is exposed by a laser based optical system (laser scanner) 43 as an exposing apparatus; it is subjected to a scanning laser beam L projected from the laser scanner 43 while being modulated with the image data of a target image to reflect the pattern of the target image. As a result, an electrostatic latent image in accordance with the pattern of the target image is formed on the peripheral surface of the photosensitive drum 41.

Then, the electrostatic latent image on the photosensitive drum 41 is developed by a developing apparatus 44 into a visual image, or a toner image. As for a developing method, there are various methods, for example, a jumping developing method or a two component developing method. In many cases, these developing methods are used in conjunction with a combination of an image exposure and a reversal development.

After being formed on the peripheral surface of the photosensitive drum 41, the toner image is continuously transferred, starting from the leading end, onto a sheet of recording medium (transfer material) P delivered to a transfer nip 46, that is, a nip formed between the photosensitive drum 41 and a transfer roller 45, from a sheet feeding portion 47 with a predetermined controlled timing. More specifically, such voltage that is opposite in polarity to the polarity to which the toner is charged is applied to the transfer roller 45, causing the toner image on the photosensitive drum 41 to be continuously transferred onto the recording medium P.

The sheet feeding portion 47 in this image forming apparatus is in the form of a cassette, in which plural sheets of recording medium P are stored in layers. In operation, the sheets of recording medium P are fed out of the sheet feeding portion 47 one by one by a combination of a sheet feeder roller 48 and an unillustrated separating member, and are delivered to the transfer nip 46 by a conveyer roller pair 49, through a sheet path inclusive of a top sensor 50, with the aforementioned predetermined controlled timing.

While the recording medium P is conveyed from the sheet feeder cassette 47 to the transfer nip 46 through the sheet path 51, the leading end of the recording medium P is recognized by the top sensor 50 disposed along the sheet path 51, so that the image formation on the peripheral surface of the photosensitive drum 41 is started in synchronism with the recognition of the leading end of the recording medium P.

After the transfer of the toner image onto the recording medium P in the transfer nip 46, the recording medium P is separated from the peripheral surface of the photosensitive drum 41, starting from the leading end, and is conveyed to a fixing apparatus 54, being guided by a guide 53. In the fixing apparatus 54, the toner image is thermally fixed to the recording medium P. This fixing apparatus 54 is an induction type heating apparatus.

After the fixation of the toner image to the recording medium P in the fixing apparatus 54, the recording medium P is discharged into a sheet delivery tray 58 by a discharge roller pair 57 through a sheet path comprising a conveyer roller pair 55.

Meanwhile, the transfer-residual toner, that is, the toner which remains on the peripheral surface of the photosensitive drum 41 after the image transfer onto the recording medium P (more specifically recording sheet separation), and other contaminants, such as paper dust, adhering to the peripheral surface of the photosensitive drum 41, are removed from the peripheral surface of the photosensitive drum 41 by a cleaner 52. After the cleaning, the cleaned portion of the peripheral surface of the photosensitive drum 41 is used for the following cycle of image formation.

Figure 1:
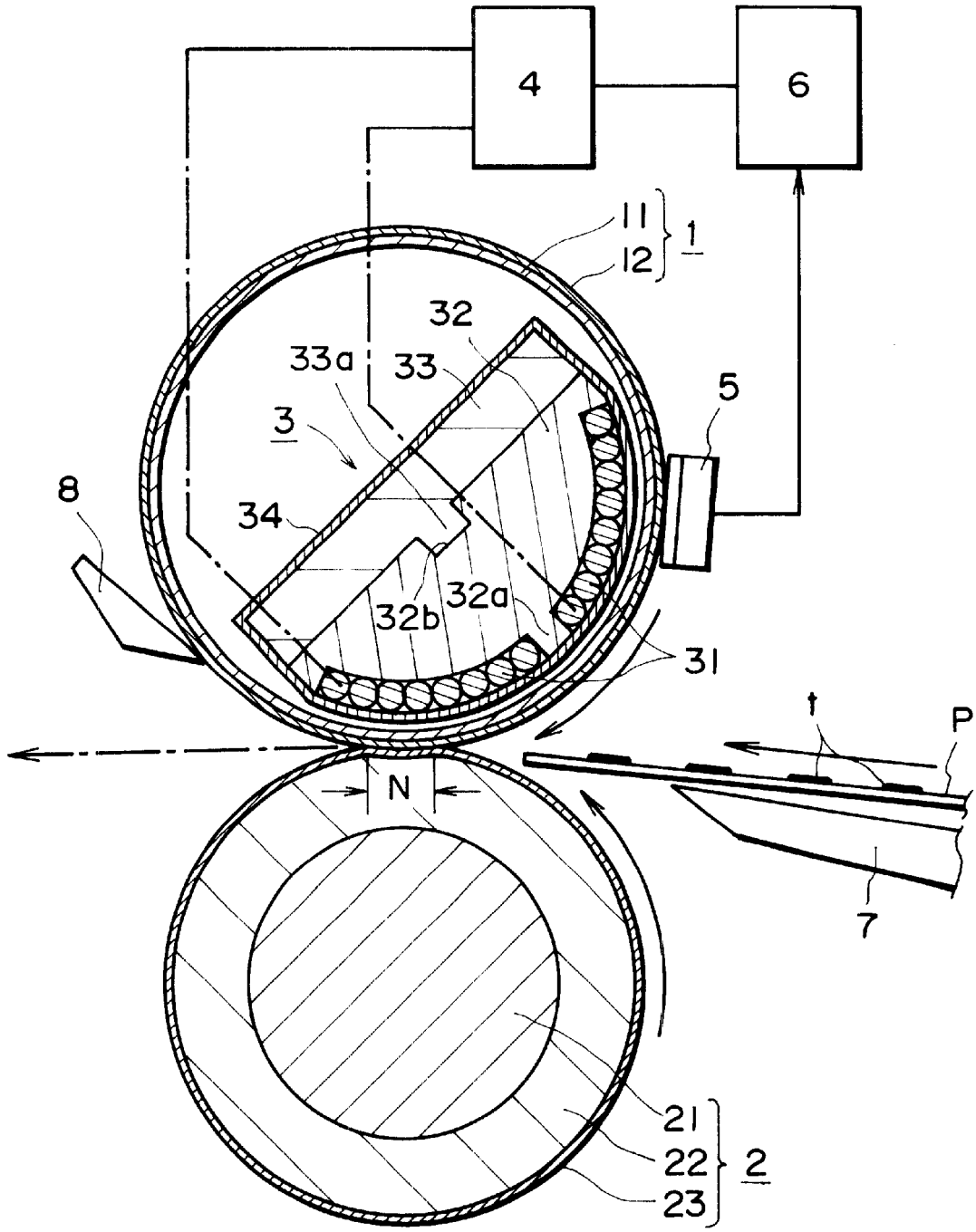
FIG. 1 is a sectional view of the image heating apparatus in the first embodiment of the present invention.

FIG. 1 is a schematic, vertical cross-sectional view of the essential portion of the fixing apparatus, as an image heating apparatus, in this embodiment of the present invention.

A referential character 1 designates a fixing roller, that is, a rotational member, which is heated by electromagnetic induction; 2, a pressure roller; 3, a unit comprising an exciter coil and a magnetic core, as a means for generating a magnetic flux; 4, a high frequency converter (exciter circuit); 5, a temperature sensor; 6, a control circuit; 7, a recording medium conveyance guide; 8, a separator pawl; P, a recording medium (recording sheet), and a referential character t designates an unfixed toner image on the recording medium P.

The fixing roller 1 and pressure roller 2 are rotatively supported in parallel to, and in contact with, each other, the former being on top of the latter, by their longitudinal ends, by unillustrated bearings. The pressure roller 2 is kept under a predetermined amount of pressure generated by a pressure generating mechanism in the direction to press the pressure roller 2 toward the rotational axis of the fixing roller 1, so that a compression nip (fixing nip) N is formed between the two rollers across the portions correspondent to the bottom-most portion of the fixing roller 1. The fixing roller 1 is rotatively driven by an unillustrated driving mechanism in the clockwise direction indicated by an arrow mark in the drawing, at a predetermined peripheral velocity. The pressure roller 2 rotates following the rotation of the fixing roller 1 because of the compressional friction between the pressure roller 2 and fixing roller 1 in the compression nip N.

a) Fixing Roller 1

The fixing roller 1, that is, a roller heated through electromagnetic induction, in this embodiment is essentially an iron cylindrical (electrically conductive layer) 11 which is 32 mm in diameter and 0.5 mm in wall thickness. The material for the fixing roller 1 may be different from the aforementioned iron; it may be any magnetic material (magnetic metal) such as magnetic stainless steel, which is relatively high in permeability $\mu$, and has a proper amount of electrical resistance P.

The peripheral surface of the metallic cylinder 11 is covered with an approximately 10–50 $\mu$m thick detachment layer 12 formed of fluorinated resin such as PTFE or PFA, so that the recording medium P easily detaches from the peripheral surface of the fixing roller 1.

In order to improve the state of contact between the peripheral surface of the fixing roller 1 and recording medium P, a functional layer, for example, a layer of heat resistant rubber or resin, the thickness of which is in several hundred micrometer range, may be placed between the metallic cylinder and detachment layer 12.

b) Pressure Roller 2

The pressure roller 2 comprises a metallic core 21 with an external diameter of 20 mm, and a 5 mm thick Si rubber layer 22 coated on the peripheral surface of the metallic core 21. It also comprises a 10–50 $\mu$m thick detachment layer 23, that is, a layer of fluorinated resin such as PTFE or PFA, which is coated over the Si rubber layer 22 to allow the recording medium P to easily detach from the peripheral surface of the pressure roller 2 as the fixing roller 1 does. Thus, the overall diameter of the pressure roller 2 is approximately 30 $\mu$m.

The pressure roller 2 is pressed upon the fixing roller 1 with an approximate pressure of 30 Kg, which makes the width of the aforementioned compression nip N approximately 4 mm. If necessary, the nip width may be changed by changing the amount of the pressure applied to the pressure roller 2.

c) Exciter Coil-Magnetic Core Unit 3

Figure 2:
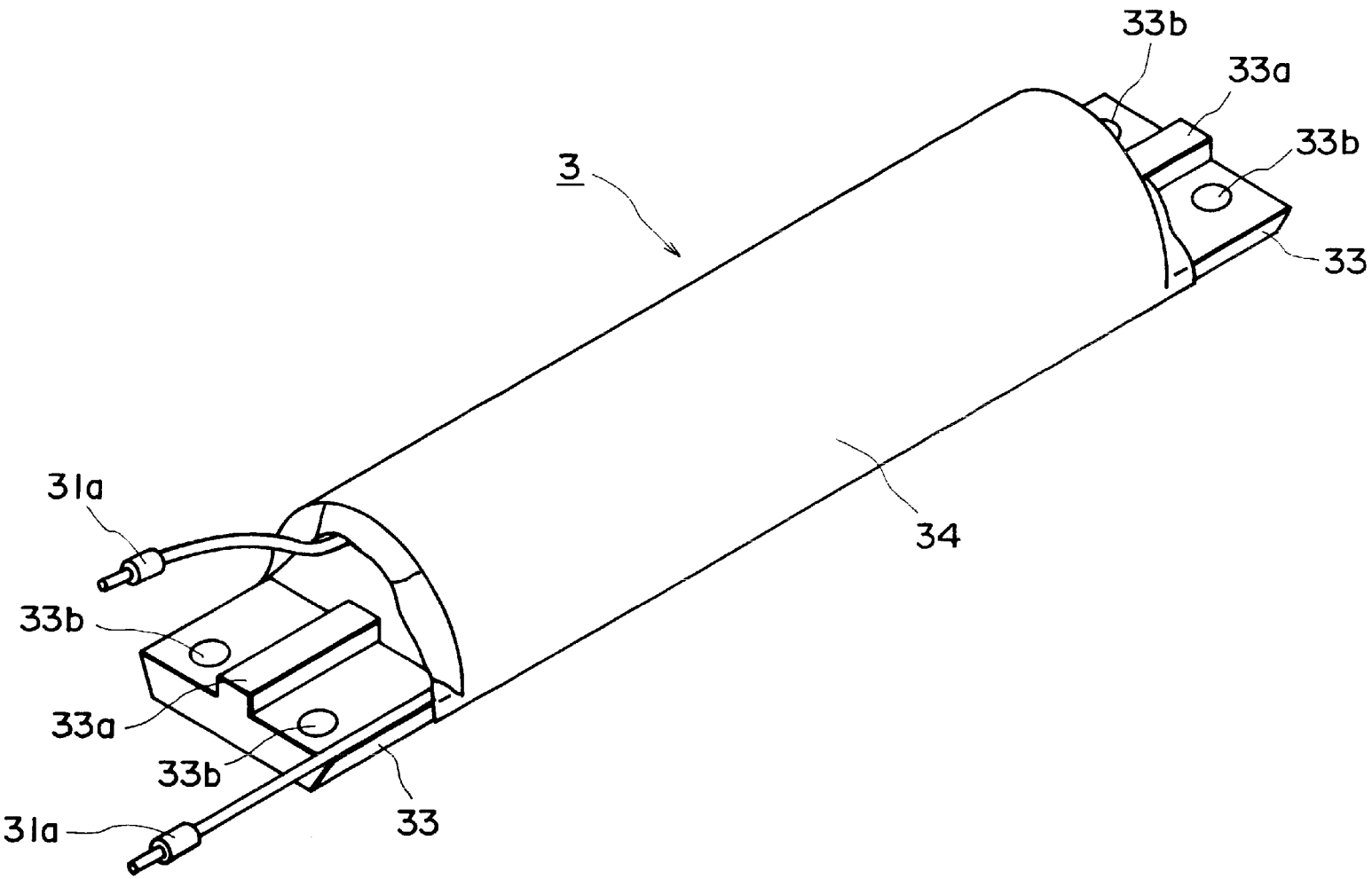
FIG. 2 is a perspective view of the coil-core combination unit.
Figure 3:
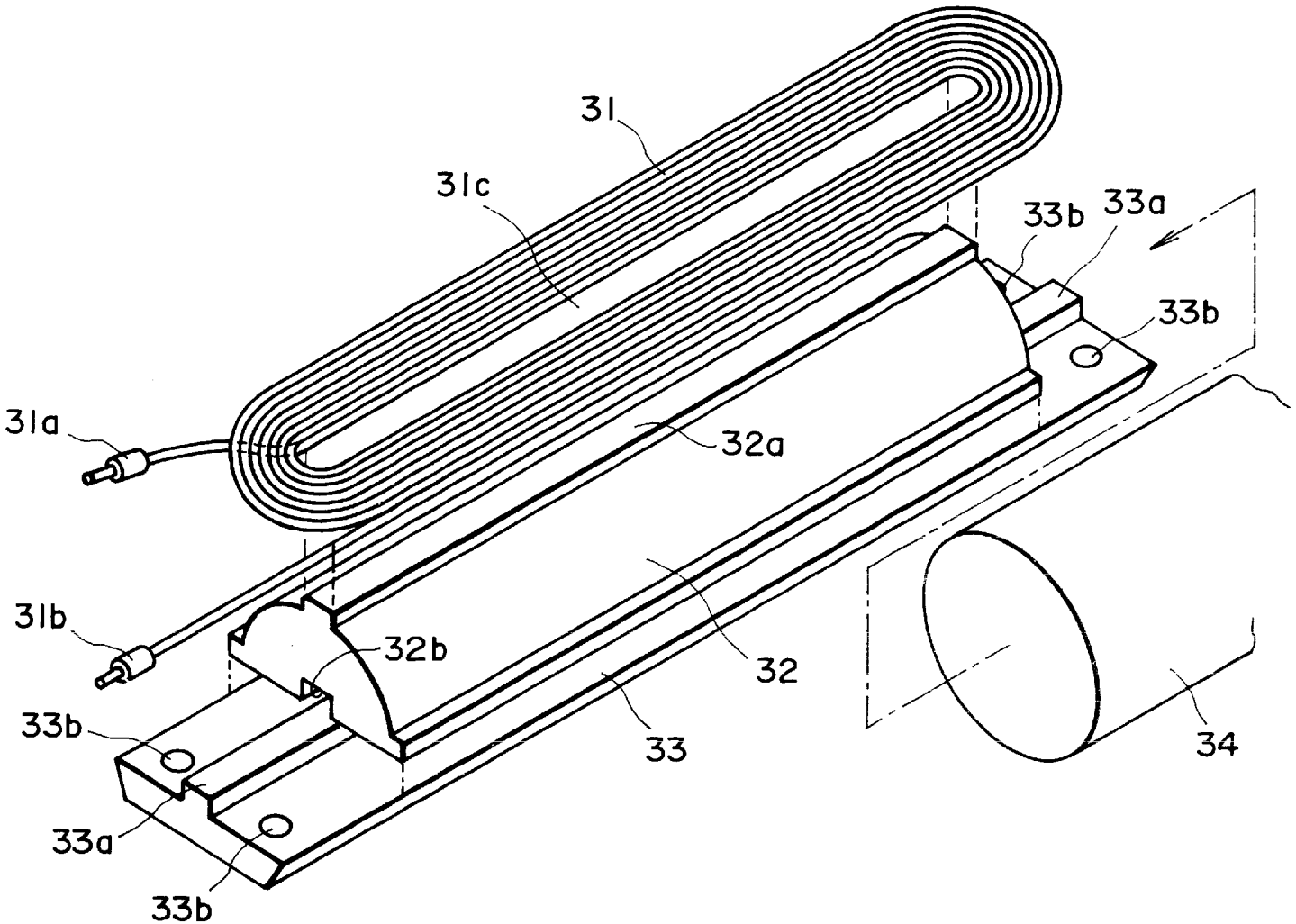
FIG. 3 is a perspective view of the aforementioned coil-core unit in the partially unassembled state, prior to the attachment of the coil.
Figure 4A:
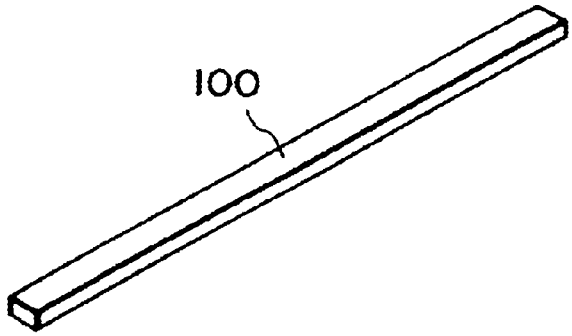
FIG. 4, which is comprised of FIGS. 4(*a*), 4(*b*) and 4(*c*), is a schematic perspective drawing which depicts the coil production process.
Figure 4B:
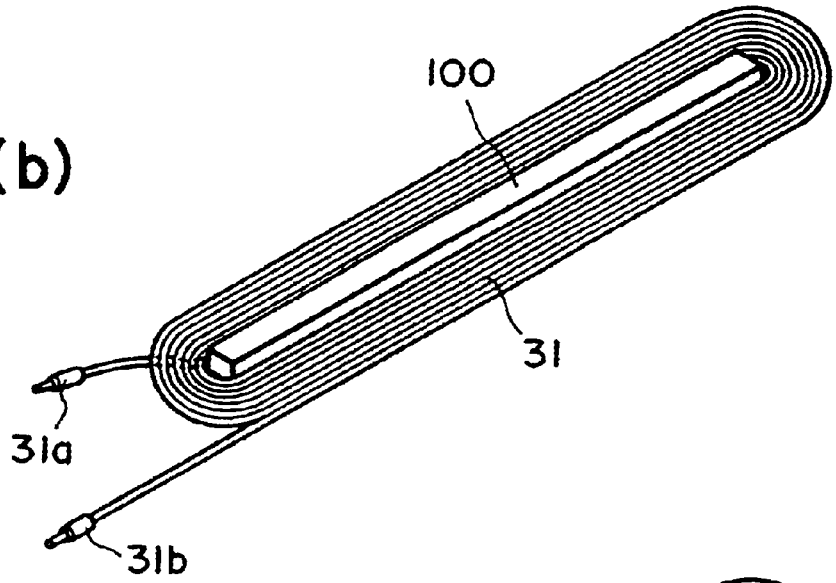
Figure 4C:
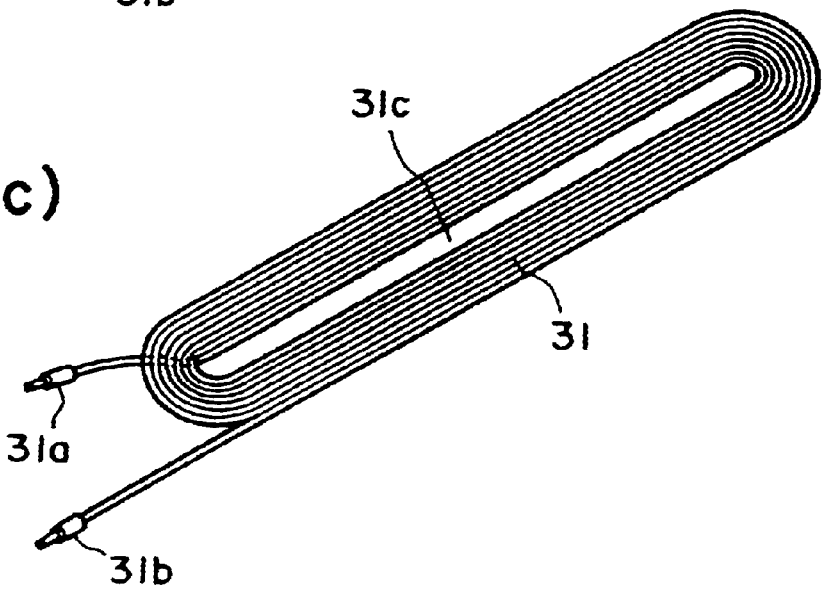

FIG. 2 is an external perspective view of the exciter coil-magnetic core unit; FIG. 3, a perspective view of the same in the unassembled state; and FIG. 4 is a schematic drawing which depicts the exciter coil production steps.

(1) The exciter coil-magnetic core unit 3 as a magnetic flux generating means comprises an exciter coil 31, a magnetic core 32, an aluminum holder 33, an electrically insulative and thermally contractible sheathing tube 34, and the like. It is placed within the fixing roller 1.

The exciter coil 31 is manufactured through the following steps. That is, first, wire for the coil is wound, spirally, flatly, and in parallel, around a core rod 100 in the form of a substantially oblong rectangular parallelepiped, illustrated in FIG. 4, (*a*), to form the exciter coil 31 which is spiral flat, and oblong, as shown in FIG. 4, (*b*). Then, the core rod 100 is removed after the pressing process or the like. FIG. 4, (*c*), shows the flat and spiral exciter coil 31 after the removal of the core rod 100. The length of this exciter coil 31 approximately corresponds to that of the fixing roller 1. Referential characters 31*a* and 31*b* designate power supply terminals provided one for one at the ends of the wire of the exciter coil 31. A referential character 31*c* designates a central void created as the core rod 100 in the form of an oblong rectangular parallelepiped is removed. It should be noted here that the longitudinal direction of the fixing roller 1 is such a direction that is perpendicular to the moving direction of the fixing roller 1.

As for the wire the exciter coil 31, Litz wire may be used; in other words, a bundle of 20–150 strands of wire, each of which is approximately 0.15–0.5 mm in diameter, and is sheathed with electrically insulative material, may be used. More specifically, in this embodiment, such Litz wire that comprises 84 strands of wire with a diameter of 0.2 mm, and is 3 mm in overall diameter, is used as the wire for the exciter coil 31. In consideration of the temperature increase of the exciter coil 31, heat resistance material is used as the material for the wire sheath.

One of the methods for increasing the amount of the heat generated in the fixing roller 1 by electromagnetic induction is to increase the amplitude of the alternating current applied to the exciter coil 31, which makes it possible to reduce the number of times the wire of the exciter coil 31 is wound. However, the reduction in the number of times the wire of the exciter coil 31 is wound results in increase in the heat generated by the electrical resistance of the exciter coil 31. Therefore, in this embodiment, the number of times the wire of the exciter coil 31 is wound is set at eight.

(2) The magnetic core 32, that is, the supporting member for the exciter coil 31, is an oblong member, the length of which approximately corresponds to that of the fixing roller 1, and the cross section of which is approximately semicircular. In other words, the magnetic core 32 is a semicylindrical member, being formed so that the curvature of its semicylindrical surface matches the curvature of the inward surface of the fixing roller 1. As for the material for the magnetic core 32, such materials that are high in permeability and low in loss should be used for the efficiency of the magnetic circuit, and also for shielding magnetism.

A referential character 32*a* designates a projecting portion of the magnetic core 32, which radially projects from the approximate longitudinal center line of the semicylindrical surface of the magnetic core 32, and extends the entire length of the longitudinal center line. The shape of this oblong projecting portion 32*a* is approximately the same as that of the aforementioned core rod 100 in the form of the oblong rectangular parallelepiped for winding wire for the exciter coil 31. A referential character 32*b* designates an oblong groove which is in the flat surface of the magnetic core 32, that is, the surface opposing the semicylindrical surface, and extends in the longitudinal direction of the magnetic core 32, at the approximate center of the flat surface.

(3) The aluminum holder 33 is a fairly thick and rigid member in the form of an oblong plate. Its length is greater than the length of the fixing roller 1, and its width corresponds to the width of the flat backside of the approximately semicylindrical magnetic core 32.

A referential character 33*a* designates an oblong projecting portion which projects from the approximate center, in terms of the crosswise direction, of the inward side of the holder 33, and extends in the longitudinal direction of the holder 33. The relationship between this projecting portion 33*a* and the aforementioned oblong groove 32*b* on the flat side of the magnetic core 32 is such that the former perfectly fits in the latter.

(4) The flat and spiral exciter coil 31 is joined with the magnetic core 32, as depicted in FIG. 3, that is, a perspective drawing, in such a manner that the oblong projection 32*a* on the semicylindrical surface of the magnetic core 32 fits into the oblong void which was formed in the center of the exciter coil 31 when the core rod 100 was removed. Next, the magnetic core 32 is joined with the holder 33 in such a manner that the oblong projection 33*a* on the inward side of the holder 33 fits in the oblong groove 32*b* in the flat back side of the magnetic core 32. Next, the exciter coil 31, magnetic core 32, and holder 33 are covered together with an electrically insulative, and thermally contractible tube 34, and then, the tube is thermally contracted by a sufficient amount.

The electrically insulative, thermally contractible tube 34 is formed of, for example, silicon resin, fluorinated resin, or the like. In this embodiment, it is a thermally contractible tube which is 40 mm in external diameter and 0.3 mm in thickness, prior to thermal contraction, and becomes 0.4 mm in thickness as it is thermally contracted to an external diameter of 30 mm.

As the thermally contractible tube 34 is thermally contracted by a sufficient amount, the flat and spiral exciter coil 31 is bent to follow the contour of the semicylindrical surface of the magnetic core 32; in other words, the exciter coil 31 is reshaped so that its curvature matches the curvature of the inward surface of the fixing roller 1. Further, the exciter coil 31, magnetic core 32, and holder 33 are held together, forming an exciter coil-magnetic core unit 3. FIG. 2 is an external perspective view of the thus formed exciter coil-magnetic core unit 3.

Since the exciter coil-magnetic core unit 3, in particular, the exciter coil portion, is covered with the electrically insulative, thermally contractible tube 34, across the surface which faces the inward surface of the fixing roller 1, this tube 34 functions as an electrical insulator between the exciter coil 31 and the inward surface of the fixing roller 1, improving the electrical safety.

(5) The exciter coil-magnetic core unit 3 is inserted into the internal space of the fixing roller 1, and the position and angle of the exciter coil-magnetic core unit 3 are adjusted to predetermined position and angle at which the exciter coil 31, which has been shaped to match the shape of the inward surface of the fixing roller, is held very close to the inward surface of the fixing roller 1. Then, while maintaining the above described position and angle, the unit 3 is anchored to an unillustrated supporting portion on the apparatus main assembly side, by both longitudinal ends of the holder 33, with the use of small screws. A referential character 33*b* designates a small screw hole provided at both longitudinal ends of the holder 33.

In this embodiment, the exciter coil-magnetic core unit 3 is positioned at an angle as shown in FIG. 1, that is, it is angled so that the center portion of the exciter coil 31 (oblong projections 32*a* on the semicylindrical surface of the magnetic core 32) is offset toward the upstream side of the compression nip N between the fixing roller 1 and pressure roller 2 in terms of the rotational direction of the fixing roller 1. This arrangement is made to improve the efficiency with which heat is supplied to the toner image t and recording medium P in the compression nip N. More specifically, the electrically conductive layer of the fixing roller 1 generates heats locally, that is, across the portion directly facing the exciter coil 31, and therefore, positioning the exciter coil-magnetic core unit 3 as described above so that the heat generating portion of the fixing roller 1 is positioned immediately before the compression nip N, in terms of the rotational direction of the fixing roller, improves the efficiency with which heat is supplied to the toner image t and recording medium P in the compression nip N.

d) Heating of Fixing Roller 1 and Temperature Control

The exciter coil 31 is connected to a high frequency converter 4 so that an alternating current in a frequency range of 10–100 kHz is applied to the exciter coil 31 to supply the exciter coil 31 with high frequency power by an amount as high as 2,000 W. The magnetic field induced by the alternating current which flows through the exciter coil 31 generates eddy current in the fixing roller 1, adjacent to the inward surface of the metallic cylinder 11, and this eddy current generates Joule heat in the metallic cylinder 11 (electromagnetic induction heating). As a result, the entirety of the fixing roller 1 is subjected to this electromagnetically induced heat in the metallic cylinder 11.

The temperature sensor 5 is a thermistor, for example, which is positioned so that it makes contact with the outward surface of the fixing roller 1, at a point within the range in which heat is generated. Signals representing the surface temperature of the fixing roller 1 detected by this temperature sensor 5 are inputted into the control circuit 6. The control circuit 6 controls the high frequency converter 4 on the basis of the fixing roller surface temperature signals inputted from the temperature sensor 5; it increases or decreases the electrical power supplied to the exciter coil 31 from the high frequency converter 4, so that the surface temperature of the fixing roller 1 remains stable at a predetermined level. In other words, the surface temperature of the fixing roller 1 is automatically controlled.

e) Fixing Operation

As the fixing roller 1 is rotatively driven, the pressure roller 2 is rotated by the rotation of the fixing roller 1. The fixing roller 1 is placed under automatic temperature control so that the surface temperature of the fixing roller 1 is kept at a predetermined level by the heat electromagnetically induced is the metallic cylinder 11 of the fixing roller 1 by the function of the magnetic flux generated by the exciter coil-magnetic case unit 3 as a magnetic flux generating means. In this state, the recording medium P carrying the unfixed toner image t is conveyed from the image forming portion, and is guided iota the compression nip N between the fixing roller 1 and pressure roller 2. In this case, the unfixed toner, image carrying side of the recording medium P faces the using roller 1.

After being introduced into the compression nip N between the fixing roller 1 and pressure roller 2, the recording medium P is passed through the compression nip N, while belay heated by the fixing roller 1, so that the unfixed loner image t is thermally fused (fixed) to the recording medium P.

After being passed through the compression nip N, the recording medium P separates from the fixing roller 1, and is conveyed further to be discharged from the image forming apparatus. The separator pawl 8 is placed in contact with the surface of the fixing roller 1, so that, when the recording medium P remains adhered to the surface of the fixing roller 1 after its passage through the compression nip N, the recording medium P is forcefully separated from the surface of the fixing roller 1 by the separator pawl 8, to prevent a paper jam.

As described above, in this embodiment, when producing the exciter coil-magnetic core unit 3, the exciter coil 31 is initially formed list, and then, is reformed with the use of the thermally contractible tube 34 so that it conforms to the surface of the magnetic core 32, which has been preformed to match the curvature of the inward surface of the fixing roller. Therefore, it is possible to make the exciter coil 31 larger in the area facing the electrically conductive layer (metallic cylinder 11) of the fixing roller 1, and also to make the distance between the exciter coil 31 and the electrically conductive layer 11 of the fixing roller 1 uniform across the entire range of the exciter coil 31. As a result, the object to be heated can be efficiently heated. Further, the exciter coil 31 is simple in shape, making it possible to increase the production efficiency for the exciter coil 31, which is turn makes it possible to reduce the fixing apparatus cost.

Consequently, it becomes possible to improve a fixing apparatus based on electromagnetic induction heating, and an image forming apparatus equipped with such a fixing apparatus, is performance, and also to reduce their cost.

Further, is this embodiment, the exciter coil 31 and magnetic core 32 are sheathed with a thermally contractible tube, and therefore, the exciter coil 31 and magnetic core 32 are held together much more tightly and securely than conventionally improving the thermal efficiency.

As described above, is this embodiment, the wire for the coil is initially wound flat, and then, as the flatly wound wire, or the coil, is attached to the supporting member, the coil is bent so that the overall shape of the coil conform to the shape of the supporting member. Therefore, the process for attaching the coil to the supporting member in this embodiment is much simples compared to the conventional process in which the wire for the coil is wound so that it follows the semicylindrical surfaces of the supporting member from the beginning. As a result, the production efficiency for the fixing apparatus is improved.

The method for bending the flatly wound coil may be pressing or the like method. Further, the coil may be beat either as it is placed in contact with the semicylindrical surface of the supporting member, or may be bent in advance in such a curvature that conforms to the curvature of the supporting member, and those attached to the supporting member.

Figure 5A:
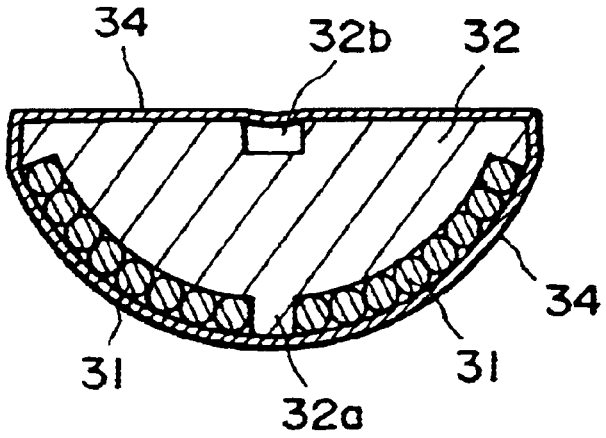
FIG. 5, which is comprised of FIGS. 5(*a*), 5(*b*) and 5(*c*), is a cross-sectional drawing of the coil-core unit, which depicts the coil-core unit production process in another embodiment of the present invention.
Figure 5B:
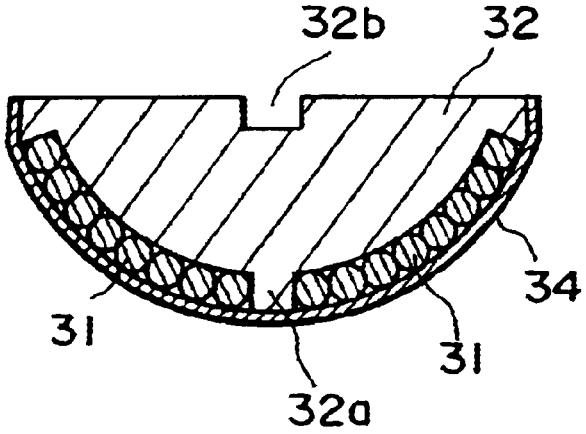
Figure 5C:
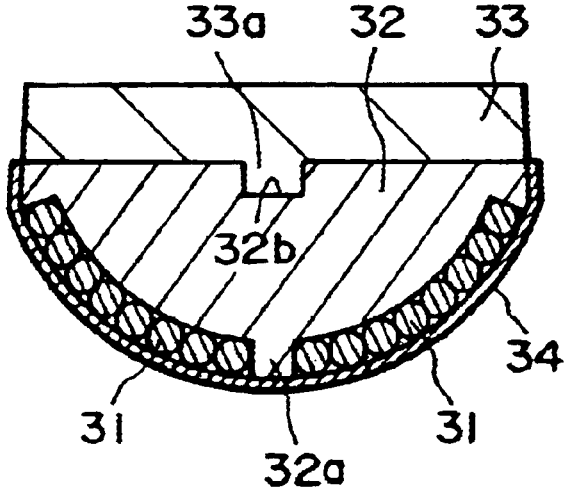

In the above described embodiment, the three components, that is, exciter coil 31, magnetic core 32, and holder 33, of the exciter coil-magnetic core unit 3 as a magnetic flux generating means are entirely sheathed together with the thermally contractible film 34. However, in this embodiment depicted is FIG. 5, (*a*), only the exciter coil 31 and magnetic core 32 are sheathed with the thermally contractible tube 34, which is thermally contracted by a sufficient amount to reshape the flatly and spirally wound exciter coil 31 so that the overall shape of the exciter coil 31 becomes matched to the shape of the semicylindrical surface of the magnetic core 32, which is the same as the curvature of the inward surface of the fixing roller 1. Than, the portion of the thermally contractible tube, which is covering the flat backside of the magnetic core 32, that is, the side which in placed is contact with the aluminum holder 33, is removed as depicted is FIG. 5, (*b*). Then, the holder 33 as directly placed in contact with the bare flat backside of the magnetic core 32, and the two are fixed to each other with small screws, producing the exciter coil-magnetic core unit 3 illustrated in FIG. 5, (*c*).

In this embodiment the heat generated by the exciter coil 31 and magnetic core 32 is swiftly transmitted to the aluminum holder 33, and then, is dissipated by the holder 33, from the anchoring portions projecting one for one from the longitudinal ends of the fixing roller. In other words, since the holder 33 is not covered with the tube, heat is quickly released into the air from the holder 33, making it possible to reduce the temperature of the exciter coil 31 and magnetic core 32. Therefore, wire which lower is heat resistance temperature, and therefore, is less expensive, can be used as the wire for the exciter coil 31, and also, material which is lower in Curia temperature, and therefore, is less expensive, can be used as the material for the magnetic core 32, making it possible to provide an inexpensive fixing apparatus.

Next, another embodiment of the present invention which makes it simpler to attach the exciter coil to the supporting member, and also can prevents the temperature drop at the longitudinal ends of the rotational members will be described.

This embodiment is the same as the preceding embodiments in terms of basic structure and therefore, only its differences from the preceding embodiments sill be described.

Figure 7:
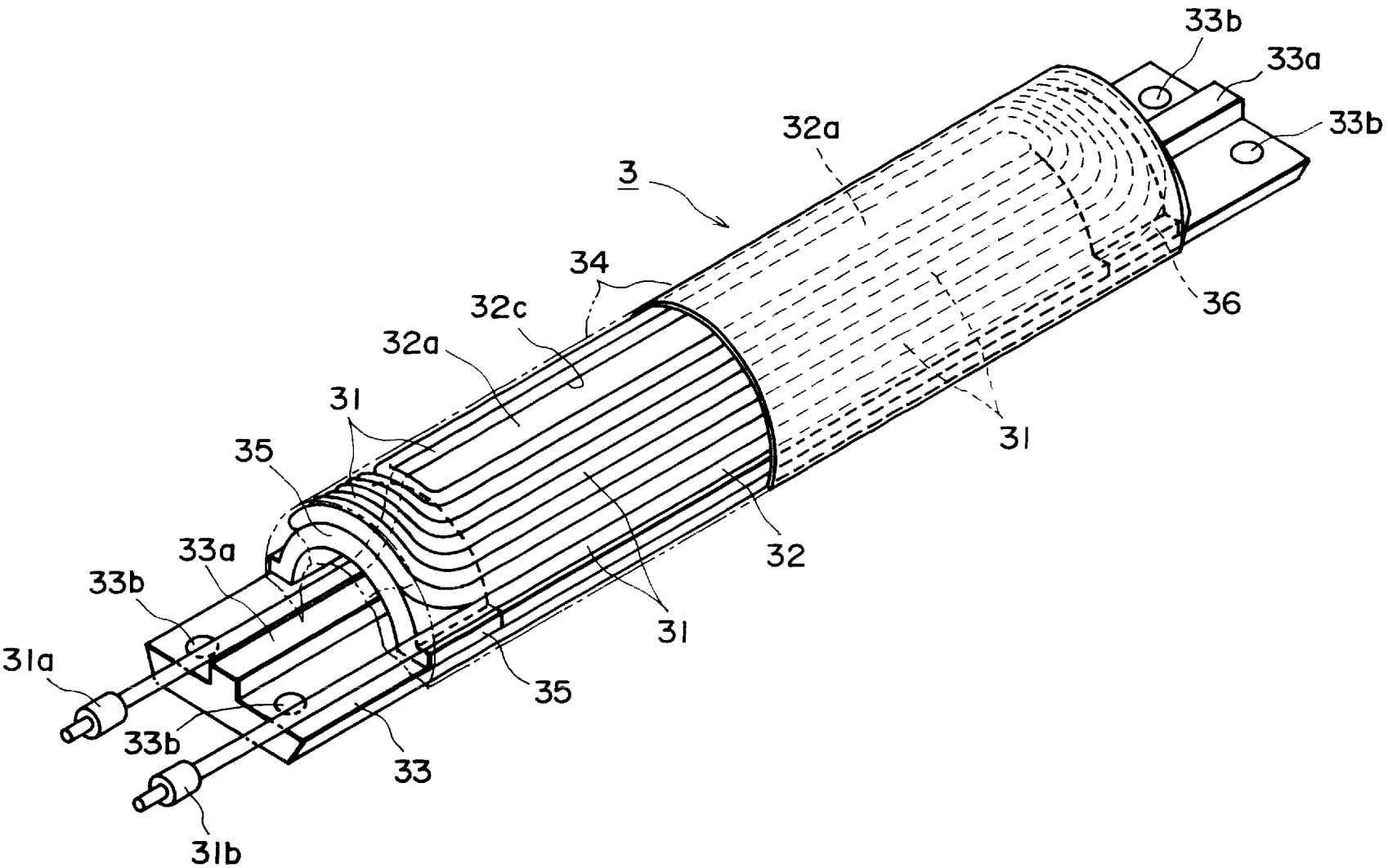
FIG. 7 is a perspective view of the coil-core unit in another embodiment of the present invention, in which certain portions of the unit are omitted to show the portions thereunder.
Figure 8:
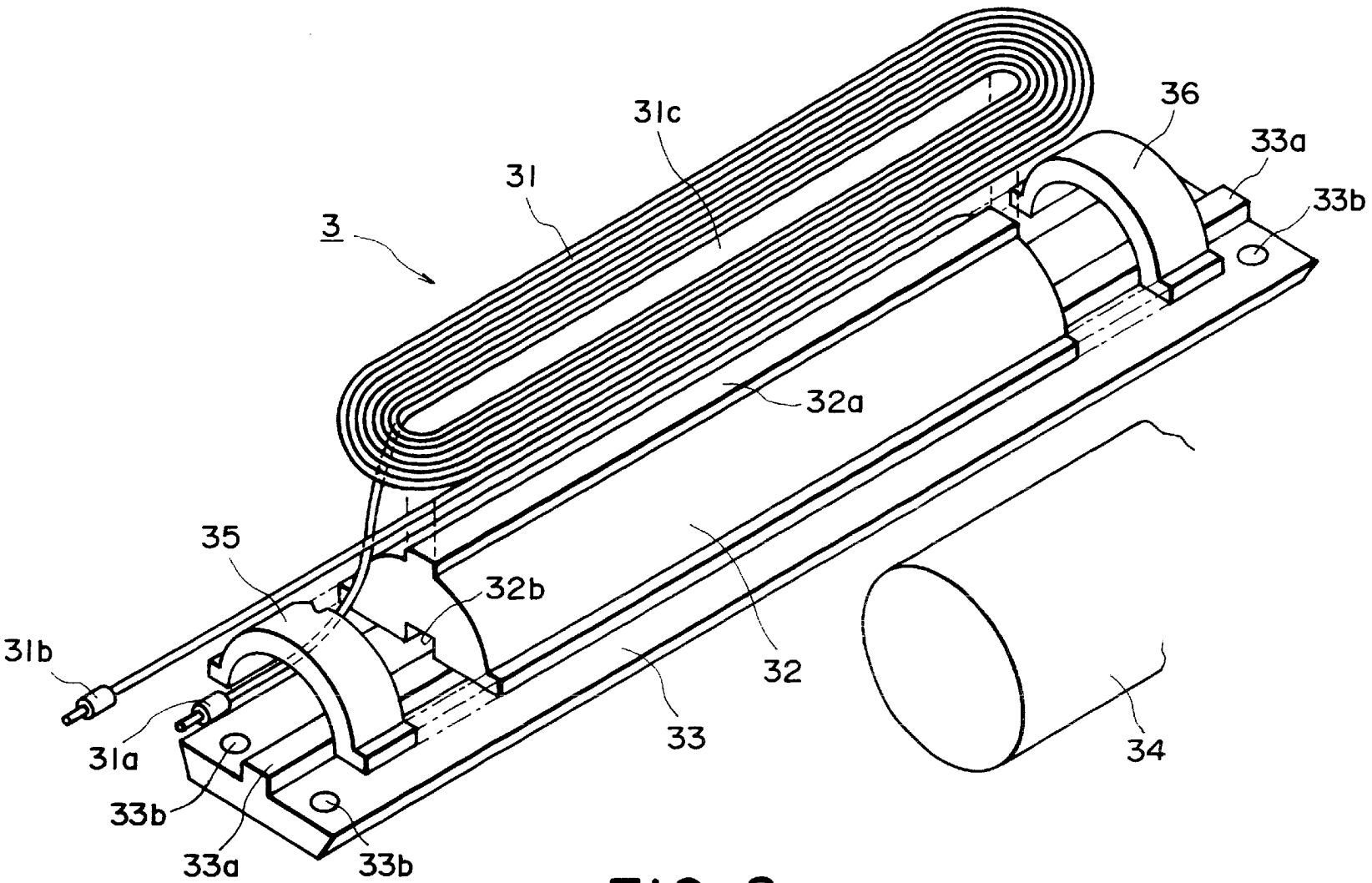
FIG. 8 is a perspective view of the partially unassembled coil-core unit, prior to the mounting of the coil.
Figure 9A:
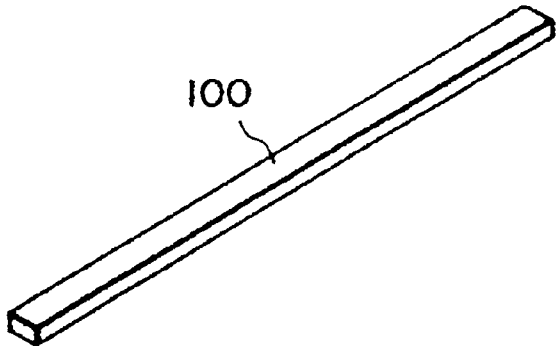
FIG. 9, which is comprised of FIGS. 9(*a*), 9(*b*), and 9(*c*), is a schematic drawing which depicts the coil projection process.
Figure 9B:
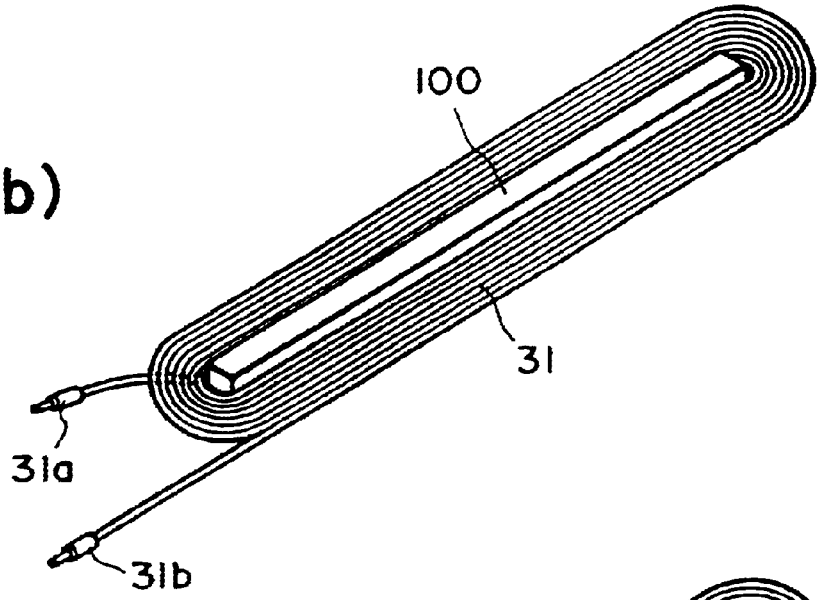
Figure 9C:
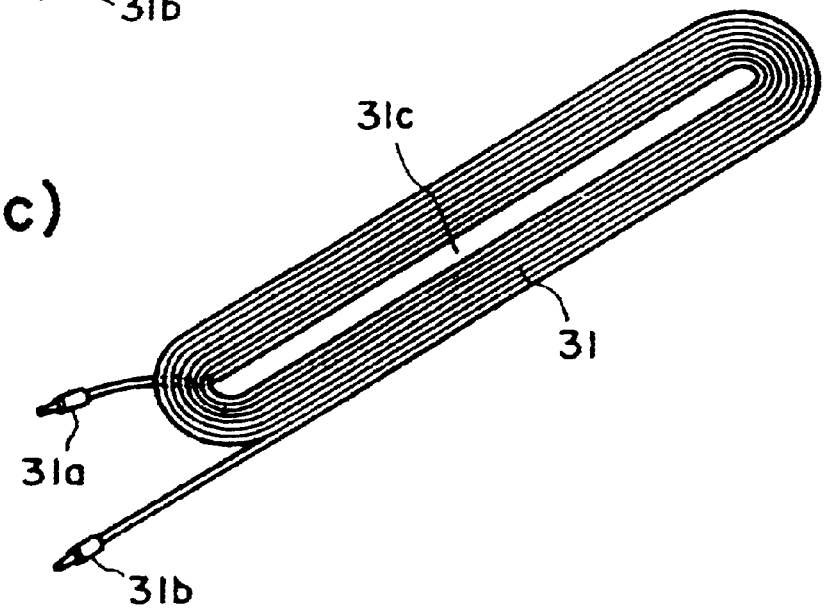

FIG. 7 is an external perspective view of the exciter coil-magnetic core unit, the portions of which have been omitted; FIG. 8, a perspective view of the same in unassembled state; and FIG. 9 is a schematic drawing which shows the production steps for the exciter coil.

(1) The exciter coil-magnetic core unit 3 as a magnetic flux generating means comprises an exciter coil 31, a plurality of magnetic cores 32, 35, and 36, an aluminum bolder 33, an electrically insulative and thermally contractible sheathing tube 34, and the like. It is placed within the fixing roller 1.

The exciter coil 31 is manufactured through the following steps. That is, first, wire for the coil is wound, spirally, flatly, and in parallel, around a core rod 100 in the form of a substantially oblong rectangular parallelepiped, illustrated in FIG. 9, (*a*), to form the exciter coil 31 which is spiral, flat, and oblong, as shown in FIG. 9, (*b*). Then, the core rod 100 is removed alter the pressing process or the like. FIG. 9, (*c*), shows the flat and spiral exciter coil 31 after the removal of the core rod 100. The length of this exciter coil 31 approximately corresponds to that of the fixing roller 1. Referential characters 31*a* and 31*b* designate power supply terminals provided one for one at the ends of the wire of the exciter coil 31. A referential character 31*c* designates a central void created as the core rod 100 in the form of an oblong rectangular parallelepiped is removed.

As for the wire for the exciter coil 31, a bundle of 20–150 strands of wire, each of which is approximately 0.15–0.5 mm in diameter, and is sheathed with electrically insulative material, may be used. More specifically, in this embodiment, such Litz wire that comprises 84 strands of wire with a diameter of 0.2 mm, and is 3 mm is overall diameter, is used as the wire for the exciter coil 31. In consideration of the temperature increase of the exciter coil 31, heat resistance material is used as the material for the wire sheath.

One of the methods for increasing the amount of the heat generated in he fixing roller 1 by electromagnetic induction is to increase the amplitude of the alternating current applied to the exciter coil 31, which makes it possible to reduce the number of times the wire of the exciter coil 31 is wound. However, the reduction in the number of times the wire of the exciter coil 31 is wound results is increase in the heat generated by the electrical resistance of the exciter coil 31. Therefore, in this embodiment, the number of times the wire of the exciter coil 31 is wound is set at eight.

(2) Among the plurality of magnetic cores 32, 35, and 36, the magnetic core 32 is the primary supporting member, that is, the central supporting magnetic core, which corresponds to the center portion of the exciter coil 31 is terms of the longitudinal direction of the fixing roller 1. The magnetic cores 35 and 36 are the secondary supporting members, that is, the end supporting magnetic cores, and correspond one for one to the longitudinal end portions of the exciter coil 31 in terms of the longitudinal direction of the fixing roller 1. As for the material for the magnetic cores 32, 35, and 36, such materials that are high in permeability and low in loss should be used for the efficiency of the magnetic circuit, and also for shielding magnetism.

The length of the central magnetic core 32 is rendered approximately the same as the length of the core rod 100 in the form of a rectangular parallelepiped around which the wire for the coil is wound as shown in FIG. 9. It is as oblong salad member with a virtually semicircular cross section, that is, as oblong, solid, and semicylindrical member. It has been process so that the curvature of its semicylindrical surface matches the curvature of the inward surface of the fixing roller. A referential character 32*a* designates a projecting portion of the magnetic core 32, which radially projects from the approximate center line of the semicylindrical surface of the magnetic core 32, is terms of the circumferential direction of the surface, and extends the entire length of the center line. The shape of this oblong projecting portion 32*a* is rendered approximately the same as that of the aforementioned core rod 100 in the form of the oblong rectangular parallelpiped for winding wire for the exciter coil 31. A referential character 32*b* designates as oblong groove which is in the flat backside surface the magnetic core 32, that is, the surface opposing the semicylindrical surface, and extends is the longitudinal direction of the magnetic core 32, at the approximate center of the flat surface. The magnetic cores 35 and 36, that is, the end cores, are also semicylindrical, but are not solid. Their walls are given such a curvature that matches the curvature of the inward surface of the fixing roller 1. One of them is potential in contact with one of the longitudinal ends of the central magnetic core 32, and the other is positioned is contact with the other longitudinal end of the central magnetic core 32, being aligned is the longitudinal direction of the fixing roller 1, so that they look as if the central magnetic core 32 were extended.

(3) The length of the aluminum holder 33 is greater than the length of the fixing roller 1, and its width corresponds to the width of the flat backside of the approximately semicylindrical central magnetic core 32. In other cords, the aluminum holder 33 is a fairly think and rigid member in the form of an oblong plate.

A referential character 33*a* designates an oblong projecting portion which projects from the approximate center is terms of the crosswise direction of the inward side of the holder 33, and extends in the longitudinal direction of the holder 33. The relationship between this projecting portion 33*a* and the aforementioned oblong groove 32*b* on the flat side of the magnetic core 32 to such that the former perfectly fits is the latter.

(4) The flat and spiral exciter coil 31 is joined with the central magnetic core 32, as depicted in FIG. 8, that is, a perspective view of the exciter coil-magnetic core unit in the unassembled state, in such a manner that the oblong projection 32*a* on the semicylindrical surface of the magnetic core 32 fits into the central oblong void which was formed in the center of the exciter core 31 when the core rod 100 was removed. Next, the central magnetic core 32 is joined with the holder 33 in such a manner that the oblong projection 33*a* on the inward side of the holder 33 fits in the oblong groove 32*b* in the flat backside of the magnetic core 32.

Next, the end magnetic cores 35 and 36 are positioned one for one at the longitudinal ends of the central magnetic core 31 so that they look as if they were the extension of the central core 32. In this state, one of end portions of the coil wire, more specifically, the end portion on the side where the winding of the exciter coil 31 began, is put through the space under the arc-shaped end magnetic core 35, and is led outward in the longitudinal direction of the fixing roller from under the end magnetic core 35. The end magnetic cores 35 and 36 correspond, in size and position, to the longitudinal end portions of the exciter coil 31, one for one, which extend beyond the longitudinal ends of the central magnetic core 32.

Next, a subassembly comprising exciter coil 31, magnetic cores 32, 35, and 36, and holder 33, are covered together with an electrically insulative, and thermally contractible tube 34, and then, the tube is thermally contracted by a sufficient amount. The electrically insulative, thermally contractible tube 34 is formed of, for example, silicon resin, fluorinated resin, or the like. In this embodiment, it is a thermally contractible tube which is 40 mm in external diameter and 0.3 mm in thickness, prior to thermal contraction, and becomes 0.4 mm in thickness as it is thermally contracted to an external diameter of 30 mm.

As the thermally contractible tube 34 is thermally contracted by a sufficient amount, the center portion of the flat and spiral exciter coil 31 is bent to follow the contour of the semicylindrical surface of the central magnetic core 32, and the both longitudinal, and portions of the exciter coil 31 are bent to follow the contour of the semicylindrical surface of the arc-shaped and magnetic cores 35 and 36; in other words, the exciter coax 31 is shaped so that its curvature matches the curvature of the inward surface of the fixing roller 1. Further, the exciter coil 31, magnetic cores 32, 35, and 36, and holder 33 are held together, forming an exciter coil-magnetic core unit 3. FIG. 7 is as external perspective view of the three formed exciter coil-magnetic core unit 3, is which some portions of the unit 3 are not illustrated.

Since the exciter coil-magnetic coca unit 3, in particular the exciter coil portion, is covered with the electrically insulative thermally contractible tube 34, across the surface which faces the inward surface of the fixing roller 1, this tube 34 functions as an electrical insulator between the exciter coil 31 and the inward surface of the fixing roller 1, improving the electrical safety.

The end magnetic core 36, that is, the end magnetic core on the aide where the end portion of the coil wire is not put through, may be a solid magnetic core.

(5) The exciter coil-magnetic core unit 3 is inserted into the internal space of the fixing roller 1, and the position and angle of the exciter coil-magnetic core unit 3 are adjusted to predetermined position and angle at which the excite coil 31, which has been shaped to match the shape of the inward surface of the lining roller, is held very close to the inward surface of the fixing roller 1. Then while maintaining the above described position and angle, the unit 3 is anchored to as unillustrated supporting portion on the apparatus main assembly side, by both longitudinal ends of the holder 33, with the use of small screws. A referential character 33*b* designates a small screw hole provided at both longitudinal soda of the holder 33.

In this embodiment, the exciter coil-magnetic core unit 3 is positioned at as angle as shown is FIG. 1, that is, it is angled so that the center portion of the exciter coil 31 (oblong projection 32*a* on the semicylindrical surface of the magnetic core 32) is offset toward the upstream side of the compression nip N between the fixing roller 1 and pressure roller 2 in terms of the rotational direction of the lining roller 1. This arrangement is made to improve the efficiency with which heat is supplied to the toner image t and recording medium P is the compression nip N. Mare specifically, the electrically conductive layer of the fixing roller 1 generates heats locally, that is, across the portion directly facing the exciter coil 31, and therefore, positioning the exciter coil-magnetic cola unit 3 as described above so that the heat generating portion of the fixing roller 1 is positioned immediately before the compression nip N, in terms of the rotational direction of the fixing roller, improves the efficiency with which heat is supplied to the toner image t and recording medium P in the compression nip N.

As described above, is this embodiment, when producing the exciter coil-magnetic core unit 3, the exciter coil 31 is initially formed flat, and then, is reformed with the use of the thermally contractible tube 34 so that it shape conforms to the surface of the magnetic cores 32, 35, and 36, which have been preformed to match the curvature of the inward surface of the fixing roller. Therefore, it is possible to make the exciter coil 31 larger, in the area facing the electrically conductive layer (metallic cylinder 11) of the fixing roller 1, and also to make the distance between the exciter coil 31 and the electrically conductive layer 11 of the fixing roller 1 uniform across the entire range of the exciter coil 31. As a result, the object to be heated can be efficiently heated. Further, the excites coil 31 is simpler in shape, making it possible to increase the production efficiency for the exciter coil 31, which is turn makes it possible to reduce the fixing apparatus cost.

As described above, is this embodiment the longitudinal end portions of the exciter coil, which extend beyond the longitudinal ends of the projection 32*a* of the magnetic core 32, are shaped to follow the correspondent semicylindrical surfaces of the magnetic cores 35 and 36, that is, the supporting portions, assuring that these portion of the exciter coil also contribute to the heating of the fixing roller. Therefore, the temperature drop at the longitudinal ends of the fixing roller can be reduced.

Further, as described above, in this embodiment, the longitudinal end portions of the exciter coil 31 are supported, one for one, by the end magnetic cords 35 and 36, the semicylindrical surfaces of which match the exciter coil 31 in curvature, and these end magnetic cores 35 and 36 generate stronger magnetic fields in the fixing roller 1, across the portions which these end, magnetic cores 35 end 36 face. These stronger magnetic fields generate an additional amount of heat, which compensates for the heat loss which occurs at the longitudinal ends of the fixing roller 1, reducing the temperature difference between the center portion and each longitudinal end of the fixing roller 1. In other words, this embodiment can make the surface temperature of the fixing roller 1 uniform is terms of the longitudinal direction.

In other words, a magnetic circuit with better efficiency can be created by the provision of the end magnetic cores 35 and 36, which in turn increases the density of the magnetic flux which penetrates the electrically conductive layer (metallic cylinder 11) is the longitudinal; and portions of the fixing roller 1, which are correspondent to the end magnetic cores 33 and 36. The increased magnetic flux density increases the amount of heat generated in the electrically conductive layer in the longitudinal end portions of the fixing roller, compensating for the heat loss which occurs at the longitudinal ends of the fixing roller. As a result the temperature difference between the center portion end each longitudinal end of the fixing roller becomes smaller; the surface temperature of the fixing roller 1 becomes uniform is terms of the longitudinal direction of the fixing apparatus.

Figure 10:
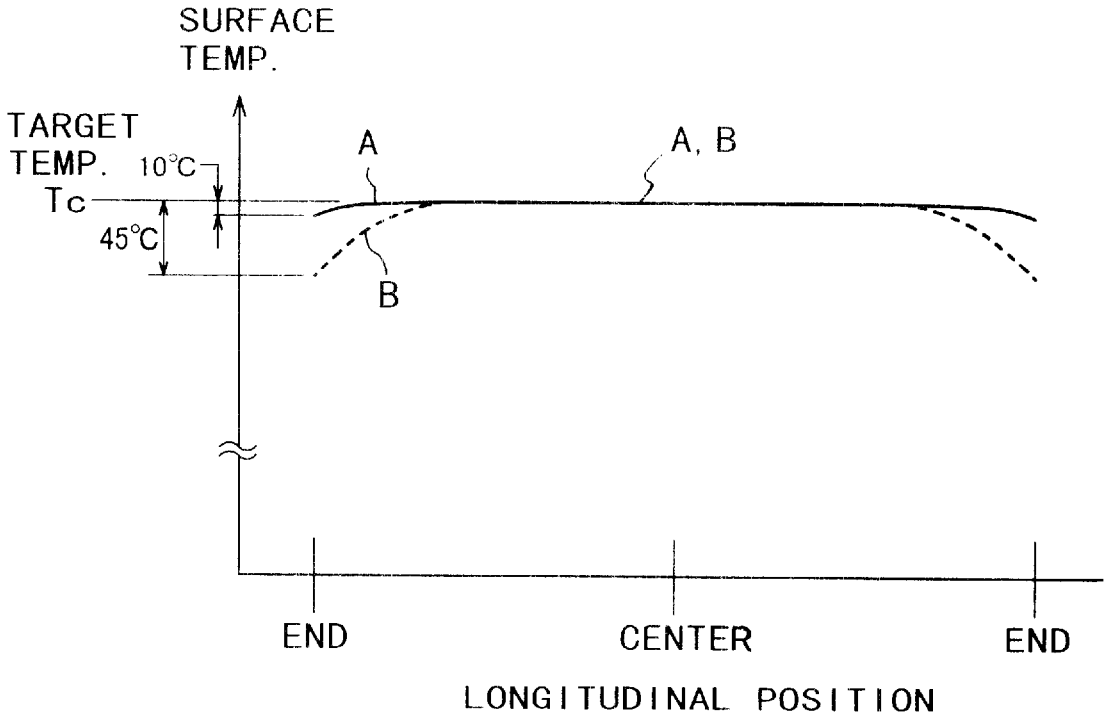
FIG. 10 is a graph which shows the surface temperature distribution of the fixing roller in terms of its longitudinal direction.

More specifically, referring to FIG. 10, when the end magnetic core 35 and 36 are not provided, the surface temperature distribution of the fixing roller 1 in the longitudinal direction is nonuniform as represented by the broken line B, with the presence of a temperature difference of 40° C. between the center portion and each longitudinal end portion of the fixing apparatus, whereas when the end magnetic cores 35 and 36 are provided, the surface temperature differences between the center portion and each longitudinal end portion is no mores than 10° C.; the surface temperature distribution of the fixing roller 1 is better in terms of uniformity.

As is evident from the above description, this embodiment can improve the performance of a fixing apparatus based on an electromagnetic induction heating system and an image forming apparatus equipped with such a fixing apparatus, and also can reduce their costs.

Figure 11:
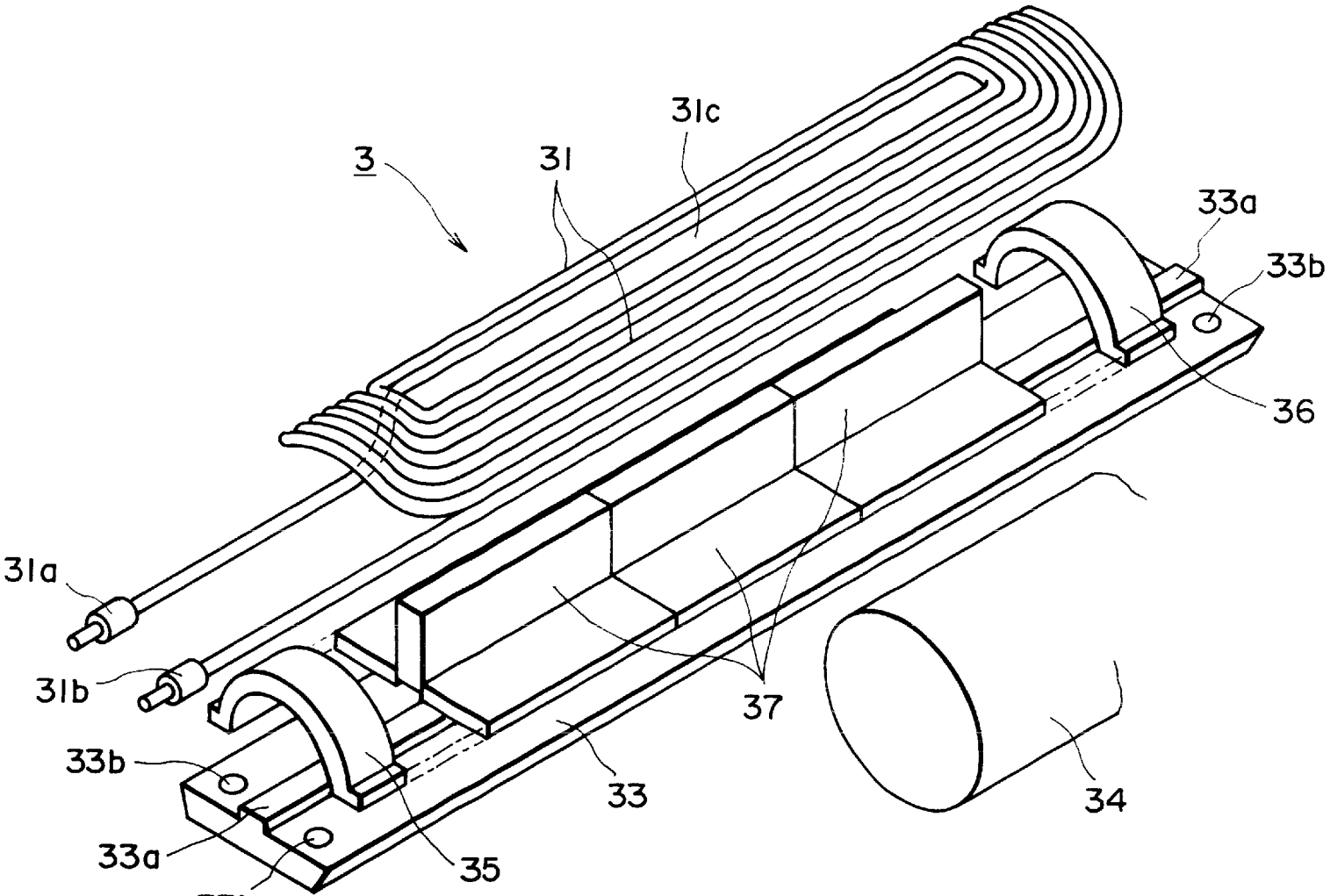
FIG. 11 is a perspective view of the partially unassembled coil-core unit in another embodiment of the present invention, prior to the mounting of the coil.

In this embodiment, the portion correspondent to the central magnetic core 32 of the exciter coil-magnetic core unit 3 is the preceding embodiment is given a T-shaped cross-section. More specifically, referring to FIG. 11, which is a perspective view of the exciter coil-magnetic core unit 3 in the unassembled state in this embodiment, the exciter coil-magnetic core unit 3 in this embodiment comprises a plurality of sub-magnetic cores in the form of a rectangular parallelepiped assembled so that the overall cross section of the assembly of the sub-magnetic cores becomes the shape of an alphabetical character T. The actual number of the sub-magnetic cores is the form of the rectangular parallelpiped used in this embodiment is nine; the central magnetic core 32 comprises three subsections, each of which comprises three sub-magnetic cores assembled in such a way that the overall cross-section of the assembly of the three sub-magnetic cores becomes T-shaped.

The exciter coil 31 in this embodiment is produced in the following manner. First, wire for the exciter coil 31 is first wound into a flat and spiral exciter coil 31 using the process depicted is FIG. 9, and then, prior to the assembly, the thus produced flat and spiral exciter coil 31 is processed through pressing or the like so that the curvature of the exciter coil 31 matches the curvature of the inward surface of the fixing roller 1.

Except for the central magnetic core portion, the structural component and assembly procedure of the exciter coil-magnetic core unit 3 in this embodiment arc virtually the same as those in the immediately preceding embodiment.

The exciter coil-magnetic care unit 3 and fixing apparatus in this embodiment provide the same function and efficiency an those provided by the immediately preceding embodiment.

Also in this embodiment, the plurality of sub-magnetic cores in the form of a rectangular parallelepiped are combined to form the central magnetic core 32 with a T-shaped arose section. The thus formed central magnetic core and the end magnetic cores 35 and 36 cooperate to make the surface temperature of the fixing roller 1 substantially uniform in terms of the longitudinal direction of the fixing roller 1. In other words, this embodiment makes it possible to use the central magnetic core comprising a combination of a plurality of sub-magnetic cores, which are simple in shape and low in cost and therefore, it is possible to reduce the fixing apparatus cost.

In the preceding descriptions of the preferred embodiments of the present invention, the rotational member was referred to ac a roller. However, the rotational member may be in the form of an endless piece of film.

The choice of the principle and processes which are used by an image forming apparatus to form a visible image on recording medium are optional.

The fixing apparatus to which the present invention is applicable also includes an image heating apparatus for heating a recording medium, an which an image is borne, to improve the surface characteristic of the recording medium, for example texture, an image heating apparatus for temporarily fixing so image, or the like.

While the invention has been described with reference to the structures disclosed herein, it is not confined to the details set forth, and this application is intended to cover such modifications or changes as may come within the purposes of the improvements or the scope of the following claims.

What is claimed is:

1. A method of assemblying a coil onto a supporting member to be provided inside an image heating rotatable member for an image fixing apparatus, said method comprising:

a step of winding wire into a coil in a plane to provide a planar coil;

a step of mounting the planar coil on a supporting member; and a step of bending the coil after said mounting step and after positioning the coil on said supporting member.

2. A method according to claim 1, wherein the coil is bent along an arcuate surface of the supporting member.

3. A method according to claim 2, wherein outside of the supporting member and the coil is wrapped with a heat-shrinkable tube, and then the tube is shrinked by heat.

4. A method according to claim 1, wherein the planar coil is bent into conformity with an inside surface of the rotatable member into which the coil unit is inserted.

5. A method according to claim l, wherein the wire is wound around a core member, and after the core member is removed to provide a hole, into which a projection of the supporting member is engaged.

6. A method according to claim 5, wherein a portion of the coil which is outside of a longitudinal end of the projection is bent along an arcuate portion of the supporting member.

7. A method according to claim 1, wherein the supporting member is of magnetic material.

8. A method according to claim 1, wherein the supporting member has a generally T-shape as seen in a direction perpendicular to a moving direction of the rotatable member.

9. A method according to claim 1, wherein the rotatable member includes a roller.

10. A method according to claim 1, wherein said rotatable member include an endless film.

* * * * *

UNITED STATES PATENT AND TRADEMARK OFFICE

CERTIFICATE OF CORRECTION

PATENT NO. : 6,691,399 B1
DATED : February 17, 2004
INVENTOR(S) : Yasuhiro Hayashi et al.

It is certified that error appears in the above-identified patent and that said Letters Patent is hereby corrected as shown below:

Title page,
Item [57], ABSTRACT,
Lines 3 and 4, “planer” should read -- planar --.

Column 2,
Line 1, “currently” should read -- current --.
Line 42, “that” should read -- than --.

Column 8,
Line 46, “iota” should read -- into --.
Line 49, “using” should read -- fixing --.
Line 53, “belay” should read -- being --.
Line 54, “loner” should read -- toner --.

Column 9,
Lines 13, 18 and 19, “is” should read -- in --.
Line 23, “conventionally” should read -- conventionally, --.
Line 30, “simples” should read -- simpler --.
Line 35, “beat” should read -- bent --.

Column 10,
Line 4, “which” should read -- which is --, and “is” should read -- in --.
Line 12, “prevents” should read -- prevent --.
Line 17, “sill” should read -- will --.
Line 50, “is” (2nd occurrence) should read -- in --.
Line 56, “he” should read -- the --.
Line 61, “results is” should read -- results in --.

Column 11,
Lines 1, 21, 30, 39 and 55, “is” should read -- in --.
Line 13, “as” should read -- an --.
Line 14, “salad” should read -- solid --.
Line 28, “surface” should read -- surface of --.
Line 37, “is contact” should read -- in contact --.
Line 46, “think” should read -- thick --.
Line 54, “to” should read -- is --

UNITED STATES PATENT AND TRADEMARK OFFICE

CERTIFICATE OF CORRECTION

PATENT NO. : 6,691,399 B1
DATED : February 17, 2004
INVENTOR(S) : Yasuhiro Hayashi et al.

It is certified that error appears in the above-identified patent and that said Letters Patent is hereby corrected as shown below:

Column 12,
Line 29, “longitudinal, and” should read -- longitudinal end --.
Lines 36 and 57, “as” should read -- an --.
Line 38, “is” should read -- in --.
Line 39, “coca” should read -- core --.
Line 47, “aide” should read -- side --.
Line 52, “excite” should read -- exciter --.
Line 61, “soda” should read -- ends --.
Line 63, “as” should read -- an --, and “is” should read -- in --.

Column 13,
Line 3, “is” should read -- in --, and “Mare” should read -- More --.
Line 8, “cola” should read -- coil --.
Lines 14, 29 and 53, “is” should read -- in --.
Line 17, “it” should read -- its --.
Line 27, “excites” should read -- exciter --.
Line 46, “end,” should read -- end --, and “end” should read -- and --.
Line 59, “is” should read -- in --, and “longitudinal; and” should read -- longitudinal end --.
Line 66, “end” should read -- and --.

Column 14,
Lines 2, 21 and 39, “is” should read -- in --.
Line 46, “arc” should read -- are --.
Line 48, “care” should read -- core --.
Line 50, “an” should read -- as --.
Line 55, “arose” should read -- cross --.
Line 66, “ac” should read -- as --.

Column 15,
Line 9, “so” should read -- an --.

UNITED STATES PATENT AND TRADEMARK OFFICE

CERTIFICATE OF CORRECTION

PATENT NO. : 6,691,399 B1
DATED : February 17, 2004
INVENTOR(S) : Yasuhiro Hayashi et al.

It is certified that error appears in the above-identified patent and that said Letters Patent is hereby corrected as shown below:

Column 16,
Line 5, "shrinked" should read -- shrunk --.

Signed and Sealed this

Sixth Day of July, 2004

JON W. DUDAS
*Acting Director of the United States Patent and Trademark Office*